US010780964B1

(12) United States Patent
Lavarine, III

(10) Patent No.: US 10,780,964 B1
(45) Date of Patent: Sep. 22, 2020

(54) METHOD AND APPARATUS FOR PROPULSION OF KAYAKS AND OTHER WATERCRAFT

(71) Applicant: John T. Lavarine, III, Lafayette, LA (US)

(72) Inventor: John T. Lavarine, III, Lafayette, LA (US)

( * ) Notice: Subject to any disclaimer, the term of this patent is extended or adjusted under 35 U.S.C. 154(b) by 0 days.

(21) Appl. No.: 16/668,227

(22) Filed: Oct. 30, 2019

Related U.S. Application Data

(60) Provisional application No. 62/752,440, filed on Oct. 30, 2018.

(51) Int. Cl.
*B63H 16/18* (2006.01)
*B63H 11/02* (2006.01)
*B63H 16/16* (2006.01)

(52) U.S. Cl.
CPC ..... *B63H 16/18* (2013.01); *B63H 11/02* (2013.01); *B63H 16/16* (2013.01)

(58) Field of Classification Search
CPC ..... B63H 16/12; B63H 16/16; B63H 16/18; B63H 2016/185; B63H 16/20; B63H 2016/202; B63H 11/00; B63H 11/02; B63H 11/04; B63H 11/06
See application file for complete search history.

(56) References Cited

U.S. PATENT DOCUMENTS 2,556,619 A * 6/1951 Hearon ..... B63H 11/02 114/283
9,821,898 B1 * 11/2017 Whatcott ..... B63H 16/20

* cited by examiner

*Primary Examiner* — Andrew Polay
(74) *Attorney, Agent, or Firm* — Ted M. Anthony

(57) ABSTRACT

A propulsion assembly utilizes at least one fluid propulsion chamber operationally attached or mounted to a vessel. Each fluid propulsion chamber generally comprises an outer housing and an inner sleeve; the outer housing is slidably disposed relative to the inner sleeve. Each inner sleeve further includes at least one water intake vent or aperture, and at least one outlet nozzle or jet. Pedal assemblies are moveably mounted within elongated slots or apertures extending through the vessel. A linkage assembly operationally connects the pedals to the at least one fluid propulsion chamber. Force imparted on said pedals (such as by the legs/feet of a user) is transferred to the fluid propulsion chambers by said linkage assembly to generate positive thrust to propel the vessel.

16 Claims, 9 Drawing Sheets

METHOD AND APPARATUS FOR PROPULSION OF KAYAKS AND OTHER WATERCRAFT

CROSS REFERENCES TO RELATED APPLICATIONS

Priority of U.S. provisional Patent Application Ser. No. 62/752,440, filed Oct. 30, 2018, incorporated herein by reference, is hereby claimed

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to a method and apparatus for propulsion of kayaks and other personal watercraft (such as, for example, catamarans). More particularly, the present invention pertains to a method and apparatus for propulsion of watercraft using human power. More particularly still, the present invention pertains to a method and apparatus for propulsion of a watercraft using power generated by the legs of a user and/or operator of said watercraft.

2. Brief Description of the Related Art

Typically, conventional kayaks and other non-motorized personal watercraft require a user to row with a paddle or oar in order to provide propulsion force through surrounding water. Such rowing frequently requires significant upper body strength and can be physically demanding. Further, rowing is generally inefficient; in many situations, the amount of propulsion force generated by the rowing is relatively low compared to the energy that must be expended by a rider/user.

Certain conventional kayaks and other non-motorized personal watercraft include propulsion systems that are powered by the legs of a rider or passenger. Although such leg-powered drive systems can often generate greater propulsion force than conventional rowing, they can also be inefficient; such existing leg-powered propulsion systems provide relatively small drive force compared to the power input expended by said user. Further, such conventional leg-powered propulsion systems often utilize relatively large flipper-like protrusions or appendages that extend below the hull of the vessel. Such systems typically require a predetermined minimum water depth and, as a result, are not functional and cannot be used in all water bodies (especially relatively shallow water depths). Additionally, such protrusions or appendages can inadvertently contact water bottoms or other underwater obstructions, thereby reducing the effectiveness of the propulsion system and/or damaging the vessel or such protrusions.

Thus, there is a need for an efficient user-powered propulsion system that provides significant propulsion or drive force to a kayak or other non-motorized personal watercraft or other vessel. The propulsion system should be more efficient than conventional leg-powered watercraft drive systems. Further, the propulsion system should not require the use of flipper-like appendages that extend or protrude a significant distance below a hull of a vessel.

SUMMARY OF THE INVENTION

In a preferred embodiment, the present invention comprises a propulsion assembly for non-motorized personal watercraft including, without limitation, boats, kayaks, catamarans and/or other floating vessels. It is to be understood that the terms "vessel" or "watercraft" as used herein generally refer to all of the foregoing, are illustrative only, and are not intended to be limiting or restrictive in any way. The propulsion assembly of the present invention can be incorporated into a new vessel as part of the manufacturing process, or it can be installed or "retrofit" to an existing vessel as an added component.

In a preferred embodiment, the propulsion assembly of the present invention comprises at least one fluid propulsion chamber operationally attached or mounted to a vessel. Said at least one fluid propulsion chamber generally comprises an outer housing and an inner sleeve; said inner sleeve and said outer housing are slidably disposed relative to one another. Each of said at least one fluid propulsion chambers further includes at least one water intake vent or aperture, and at least one outlet nozzle or jet.

Pedal assemblies are moveably disposed within elongated slots or apertures; said elongated slots or apertures are beneficially positioned on a vessel and extend through at least one surface of said vessel. In a preferred embodiment, said pedals (and related slots) are positioned in such a manner so that they can be conveniently and comfortably contacted by the feet (and, more specifically, the soles thereof) of a user, while also permitting space or clearance for said user to bend or extend his/her legs.

A linkage assembly operationally connects said pedals to said at least one fluid propulsion chamber. Force imparted on said pedals (such as by the legs/feet of a user) is transferred to said fluid propulsion chambers by said linkage assembly. In a preferred assembly, said linkage assembly comprises a cable and pulley system; however, it is to be observed that other known linkage means can be employed without departing from the scope of the present invention.

In operation, a user can selectively impart force on said moveable pedals. Said force is transferred from said pedals to said at least one fluid propulsion chamber, thereby causing the outer housing and inner sleeve of each of said at least one fluid propulsion chambers to slidably move and interact relative to one another. As a fluid propulsion chamber extends (that is, as an inner sleeve moves outward relative to an outer housing), the inner volume of said fluid propulsion chamber increases, and water is drawn into a water intake vent or aperture of said fluid propulsion chamber. Conversely, as fluid propulsion chamber retracts or collapses (that is, as an inner sleeve moves inward relative to an outer housing), the inner volume of said fluid propulsion chamber decreases, and water is expelled or forced out of said at least one outlet nozzle or jet of said fluid propulsion chamber.

Water expelled from an outlet nozzle or jet of a fluid propulsion chamber creates positive thrust. Typically, said at least one fluid propulsion chamber is mounted or oriented so that each outlet nozzle or jet faces the rear of the vessel. As a result, the positive thrust created by functioning of the at least one fluid propulsion chamber will have the effect of propelling the vessel forward (that is, the opposite direction that the outlet nozzle(s) face). In a preferred embodiment, a diverter system can be selectively engaged to redirect flow from said outlet nozzle or jet in a different direction, thereby allowing positive thrust to move said vessel in a backward or "reverse" direction.

BRIEF DESCRIPTION OF THE DRAWINGS

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

In a preferred embodiment, the present invention comprises a propulsion assembly for non-motorized personal watercraft including, without limitation, boats, kayaks, catamarans and/or other floating vessels. As used herein, the terms "watercraft" and "vessel" generally refer to virtually any personal watercraft and are not intended to be limiting or restrictive in any way.

Figure 1:
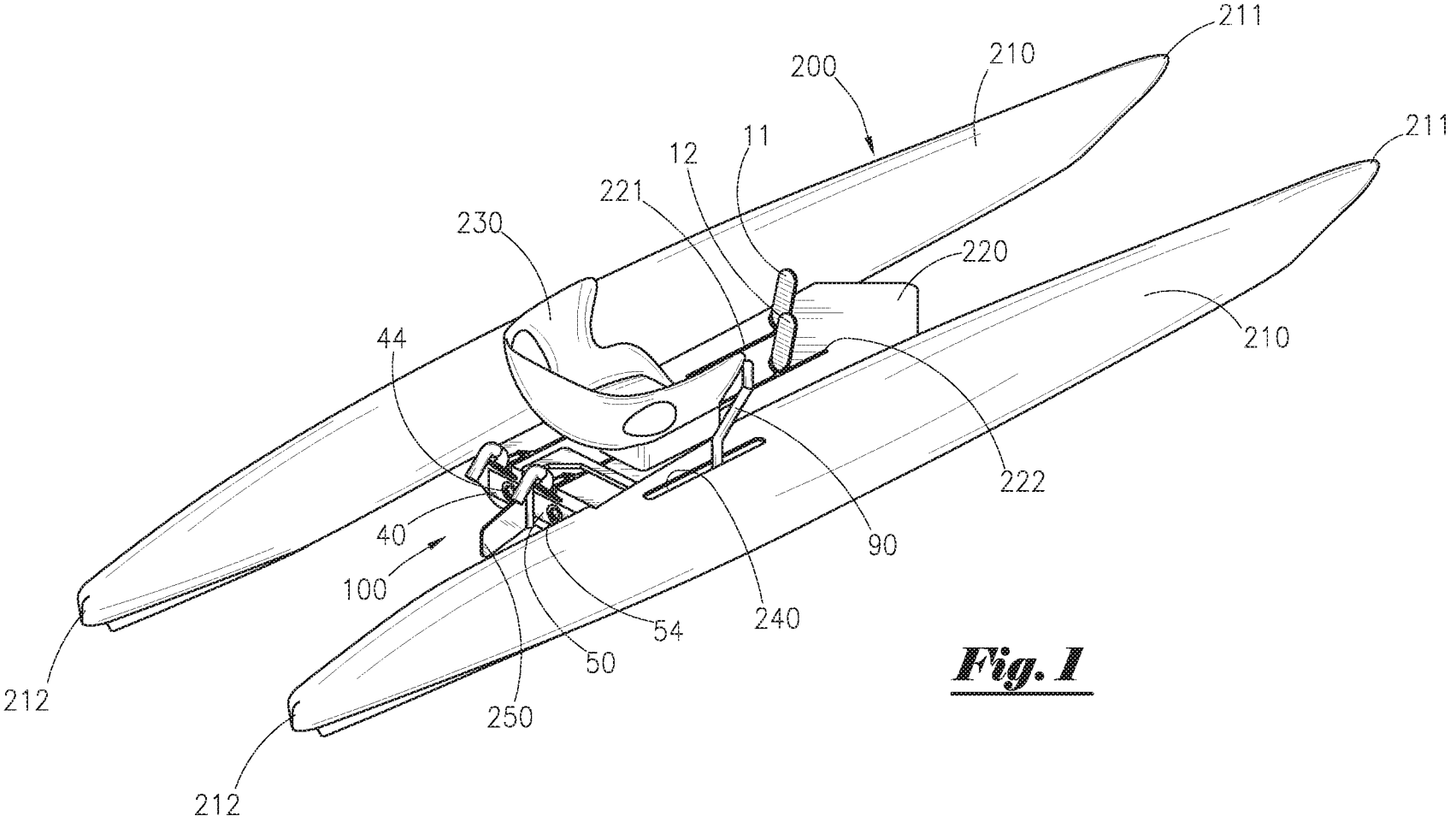
FIG. 1 depicts an overhead perspective view of the propulsion assembly of the present invention installed on a conventional watercraft.

FIG. 1 depicts an overhead perspective view of vessel propulsion assembly 100 of the present invention installed on a conventional watercraft 200. Propulsion assembly 100 of the present invention is depicted, for illustration purposes, on catamaran watercraft 200 having dual, substantially parallel hulls 210. Each of said hulls 210 has a bow (forward) end 211, and a stern (rear) end 212. Watercraft 200 is also equipped with deck 220; in the embodiment depicted in FIG. 1, said deck 220 generally comprises a planar member (having a substantially flat upper surface) positioned between said dual hulls 210. Said watercraft 200 also has steering rudder 250 that is pivotally attached to said watercraft 200. User seat 230 is disposed on the upper surface of deck 220 and generally faces bow ends 211 of hulls 210.

Elongated slots or apertures 221 and 222 beneficially extend through deck 220 of watercraft 200. In a preferred embodiment, said elongated slots 221 and 222 are arranged in substantially parallel orientation relative to each other (and to substantially parallel hulls 210). Further, in a preferred embodiment, said elongated slots 221 and 222 are generally positioned between seat 230 and stern end 211 of said hulls 210.

Pedal 11 is slidably disposed within elongated slot 221, while pedal 12 is slidably disposed within elongated slot 222; said pedals 11 and 12 can move back-and-forth along a linear path within said elongated slots 211 and 222, respectively. Pedals 11 and 12 (as well as slots 221 and 222) are also positioned so that they can be conveniently and comfortably contacted by the feet (and, more specifically, the soles thereof) of a person seated within seat 230, while also permitting space or clearance for said person to bend, flex or extend his/her legs while positioned within seat 230.

Propulsion assembly 100 of the present invention comprises at least one fluid propulsion chamber operationally attached or mounted to vessel 200. As depicted in FIG. 1, in a preferred embodiment, said at least one propulsion assembly 100 comprises two tandem propulsion chambers 40 and 50 arranged in side-by-side orientation below deck 220. Further, as depicted in FIG. 1, said propulsion chamber 40 has outlet jet nozzle 44, while propulsion chamber 50 has outlet jet nozzle 54; said outlet jet nozzles 44 and 54 are also arranged in side-by-side orientation. As depicted in FIG. 1, said outlet jet nozzles 44 and 54 are generally oriented in the direction of the stern of vessel 200 (and generally away from the bow of said vessel 200). Notwithstanding the foregoing, it is to be observed that said outlet nozzles 44 and 54 can be arranged in other orientations without departing from the scope of the present invention.

Figure 2:
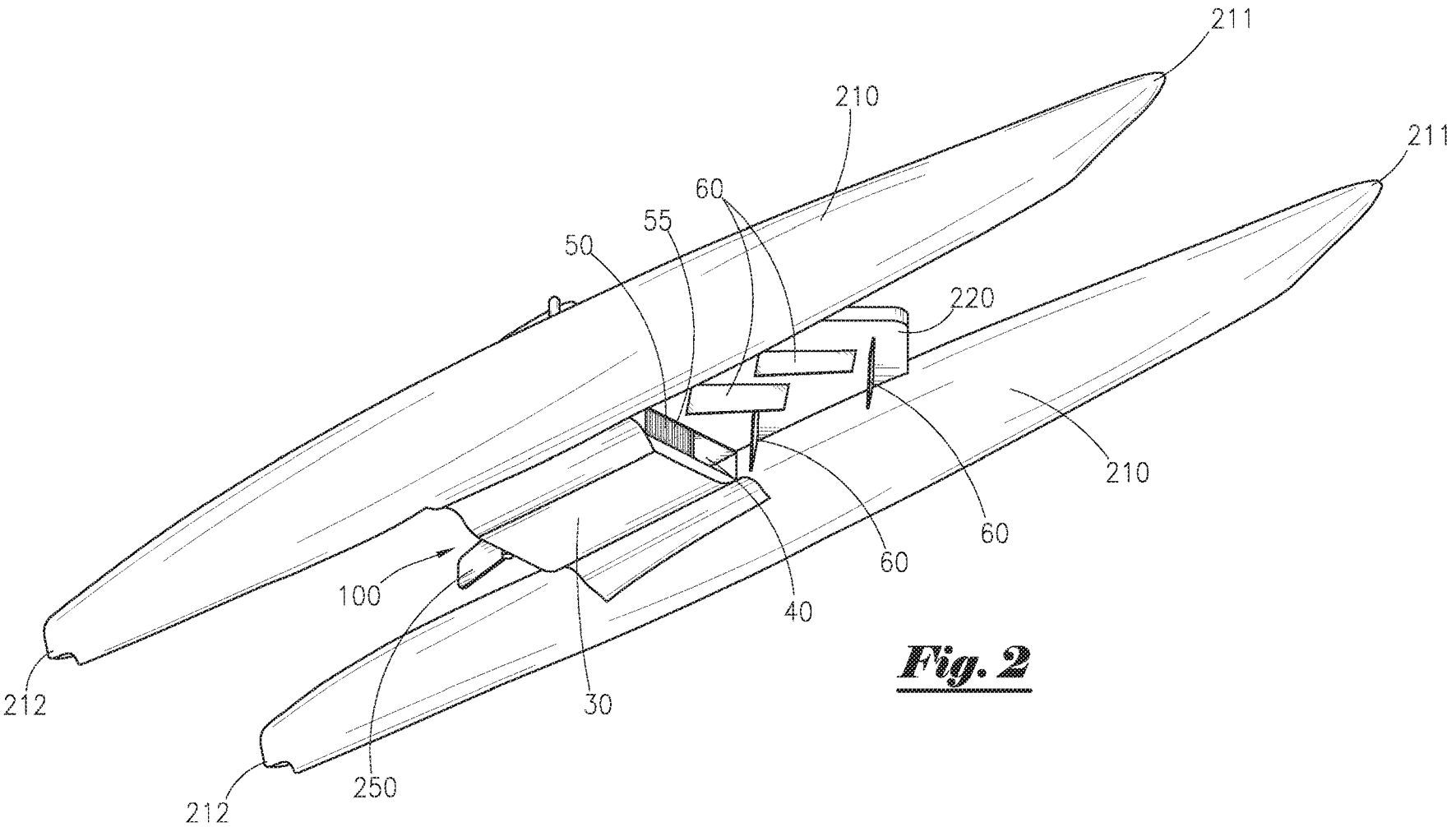
FIG. 2 depicts a bottom perspective view of the propulsion assembly of the present invention installed on a conventional watercraft.

FIG. 2 depicts a bottom perspective view of the propulsion assembly 100 of the present invention installed on a conventional watercraft 200. Propulsion assembly 100 of the present invention is depicted, for illustration purposes, on catamaran watercraft 200 having dual, substantially parallel hulls 210, each with a bow (forward) end 211, and a stern (rear) end 212. Substantially planar deck 220 is generally positioned between said dual hulls 210, while rudder 250 is pivotally attached to deck 220 on the stern-side of said deck 220.

As depicted in FIG. 2, in a preferred embodiment, propulsion assembly 100 comprises two tandem propulsion chambers 40 and 50 arranged in side-by-side orientation; said tandem propulsion chambers 40 and 50 are generally mounted within housing 30 disposed on the lower surface of deck 220. Hinged door 55 of fluid propulsion chamber 50 is depicted in the closed position; a similar hinged door, discussed in more detail herein, is also mounted in propulsion chamber 40, but is obscured from view in FIG. 2.

Still referring to FIG. 2, a plurality of fluid diverter panels 60 are disposed on the underside or lower surface of deck 220 of vessel 200. Although the specific number and orientation can vary, as depicted in FIG. 2, said fluid diverter panels 60 are mounted in substantially perpendicular arrangement to deck 220. Further, said fluid diverter panels 60 are positioned in spaced relationship, and are oriented at an acute angle relative to an imaginary bisecting line extending from the bow to the stern of vessel 200. In a preferred embodiment, fluid diverter panels 60 aligned with propulsion chamber 50 are oriented parallel to each other, while fluid diverter panels aligned with propulsion chamber 40 are oriented parallel to each other.

Figure 3:
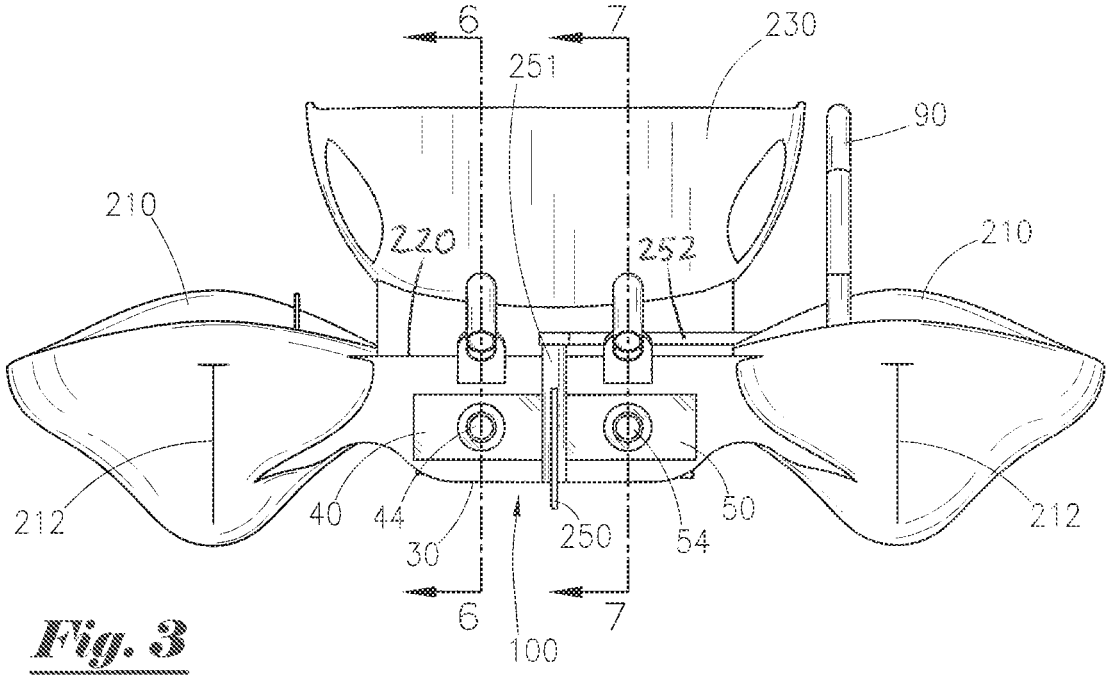
FIG. 3 depicts a rear view of the propulsion assembly of the present invention installed on a conventional watercraft.

FIG. 3 depicts a rear view of propulsion assembly 100 of the present invention installed on a conventional watercraft 200. Propulsion assembly 100 of the present invention is installed on catamaran watercraft 200 having dual, substantially parallel hulls 210, each hull 210 having a stern (rear) end 212. Deck 220 is generally positioned between said dual hulls 210, steering rudder 250 is hingedly attached to deck 220 using hinge assembly 251; the side-to-side orientation of said steering rudder 250 can be controlled using conventional steering linkage member 252. User seat 230 is disposed on the upper surface of deck 220 and generally faces away from stern ends 212 of tandem hulls 210.

Propulsion assembly 100 of the present invention comprises two tandem propulsion chambers 40 and 50 installed within propulsion chamber housing 30, and arranged in side-by-side orientation. Propulsion chamber housing 30 is disposed along the lower surface or underside of deck 220. Said propulsion chamber housing 30 can be beneficially formed during manufacture of vessel 200, or "retrofit" to attach to an existing vessel 200. Propulsion chamber 40 has outlet jet nozzle 44, while propulsion chamber 50 has outlet jet nozzle 54; said outlet jet nozzles 44 and 54 are beneficially arranged in side-by-side orientation, and generally face toward the stern of vessel 200.

As depicted in FIG. 3, the lowest point of watercraft propulsion assembly 100 (including, without limitation, propulsion chamber housing 30) does not extend below the lowest surface of hulls 210. As such, watercraft 200 can have an extremely shallow draft, thereby allowing vessel 200 equipped with propulsion assembly 100 to access relatively shallow water and, further, preventing undesired contact of said propulsion assembly 100 with a water bottom or other underwater obstruction(s).

Figure 4:
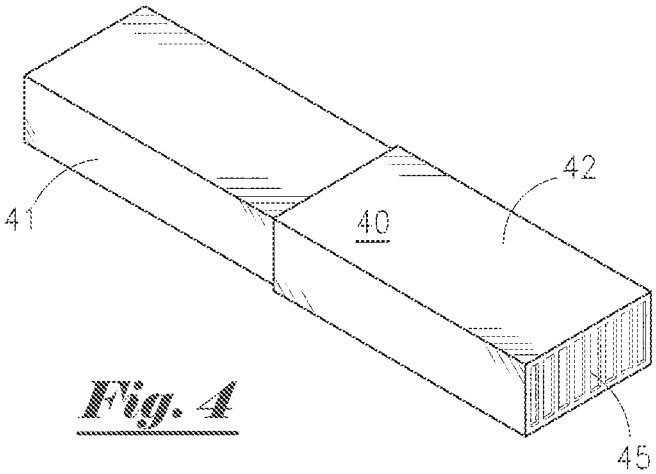
FIG. 4 depicts a perspective view of first end of a fluid propulsion chamber of the present invention.
Figure 5:
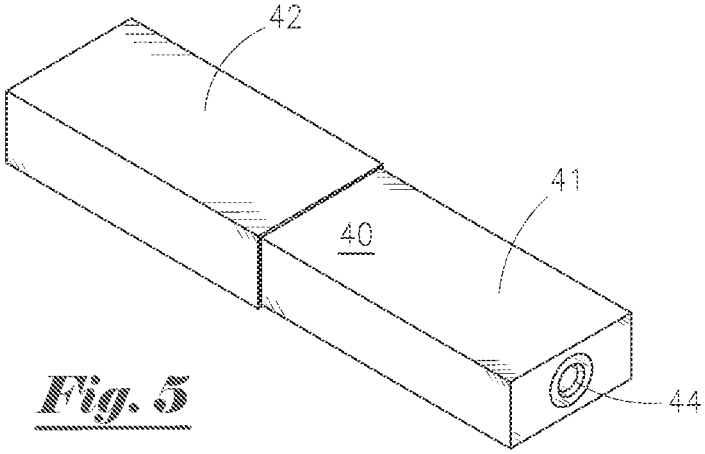
FIG. 5 depicts a perspective view of a second end of a fluid propulsion chamber of the present invention.

FIG. 4 depicts a perspective view of first end of a fluid propulsion chamber 40 of the present invention, while FIG. 5 depicts a perspective view of a second end of said fluid propulsion chamber 40. Fluid propulsion chamber 40 generally comprises an outer sleeve 42, and an inner sleeve 41, that are moveable relative to each other. Said inner sleeve 41 is slidably disposed within said outer sleeve 42, while said outer sleeve 42 is slidably disposed around at least a portion of the outer surface of said inner sleeve 41. Referring to FIG. 4, outer sleeve 42 of fluid propulsion chamber 40 further comprises at least one water intake vent or aperture which can be selectively blocked or obstructed by hinged door 45 (shown in the closed position in FIG. 4). Referring to FIG. 5, inner sleeve 41 further comprises outlet jet nozzle 44.

In a preferred embodiment, fluid propulsion chamber 40 (including, without limitation, outer sleeve 42 and inner sleeve 41) can be constructed from many different materials having desirable strength and weight characteristics including, without limitation, aluminum, PVC plastic, ABS plastic, extruded plastic, or rotomolded or thermo-formed polyethylene. In a preferred embodiment, said inner sleeve 41 and outer sleeve 42 can each have an approximate length of approximately two feet (24 inches). Notwithstanding anything to the contrary contained herein, material selection and dimensions disclosed herein are illustrative only, and must not be construed as limiting in any way.

Further, in a preferred embodiment, outer dimensions of inner sleeve 41 are slightly smaller than the dimensions of the inner chamber formed by outer sleeve 42; as a result, inner sleeve 41 is capable of extending and retracting within the inner chamber of said outer sleeve 42 along the central longitudinal axes of said inner and outer sleeves. At least one O-ring or other dynamic elastomeric seal member can be disposed at the interface between inner sleeve 41 and outer sleeve 42 (that is, on the outer surface of inner sleeve 41 and/or the inner surface of outer sleeve 42) to create a fluid pressure seal, while also promoting smoother sliding motion between inner sleeve 41 and outer sleeve 42.

Still referring to FIG. 4, a door or flap 45 is hingedly disposed at the distal end of outer sleeve 42 of fluid propulsion chamber 40. (Similarly, a door or flap 55 is also hingedly disposed at the distal end of outer sleeve 52 of fluid propulsion chamber 50, as shown in FIG. 3). Said door 45 hinges or swings inwardly within outer sleeve 42 of fluid propulsion chamber 40.

Similarly, although not depicted in FIGS. 4 and 5, it is to be observed that fluid propulsion chamber 50 is substantially identical to said fluid propulsion chamber 40. Namely, a fluid propulsion chamber 50 generally comprises an outer sleeve 52, and an inner sleeve 51 that are moveable relative to each other. Said inner sleeve 51 is slidably disposed within said outer sleeve 52, while said outer sleeve 52 is slidably disposed around the outer surface of said inner sleeve 51. Said outer sleeve 52 of fluid propulsion chamber 50 further comprises at least one water intake vent or aperture which can be selectively blocked or obstructed by hinged door 55. Inner sleeve 51 further comprises an outlet jet nozzle 54.

In a preferred embodiment, fluid propulsion chamber 50 (including, without limitation, outer sleeve 52 and inner sleeve 51) can be constructed from many different materials having desirable strength and weight characteristics including, without limitation, aluminum, PVC plastic, ABS plastic, extruded plastic, or rotomolded or thermo-formed polyethylene. In a preferred embodiment, said inner sleeve 51 and outer sleeve 52 can each have an approximate length of approximately two feet (24 inches). Notwithstanding anything to the contrary contained herein, material selection and dimensions disclosed herein are illustrative only, and must not be construed as limiting in any way.

Further, as with fluid propulsion chamber 40, outer dimensions of inner sleeve 51 are slightly smaller than the dimensions of the inner chamber formed by outer sleeve 52; inner sleeve 51 is capable of extending and retracting within the inner chamber of said outer sleeve 52 along the central longitudinal axes of said inner and outer sleeves 51 and 52. At least one O-ring or other dynamic elastomeric seal member can be disposed at the interface between inner sleeve 51 and outer sleeve 52 (that is, on the outer surface of inner sleeve 51 and/or the inner surface of outer sleeve 52) to create a fluid pressure seal, while also promoting smoother sliding motion between said inner sleeve 51 and outer sleeve 52.

Figure 6A:
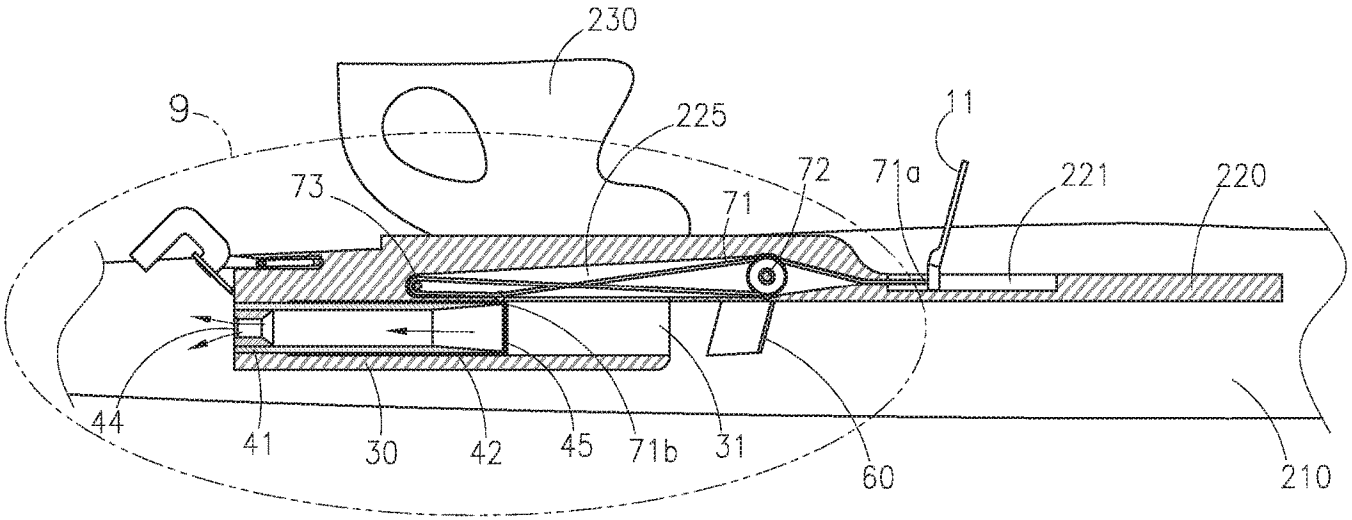
FIG. 6A depicts a side sectional view of the propulsion assembly of the present invention along line 6-6 of FIG. 3 in a first position.
Figure 6B:
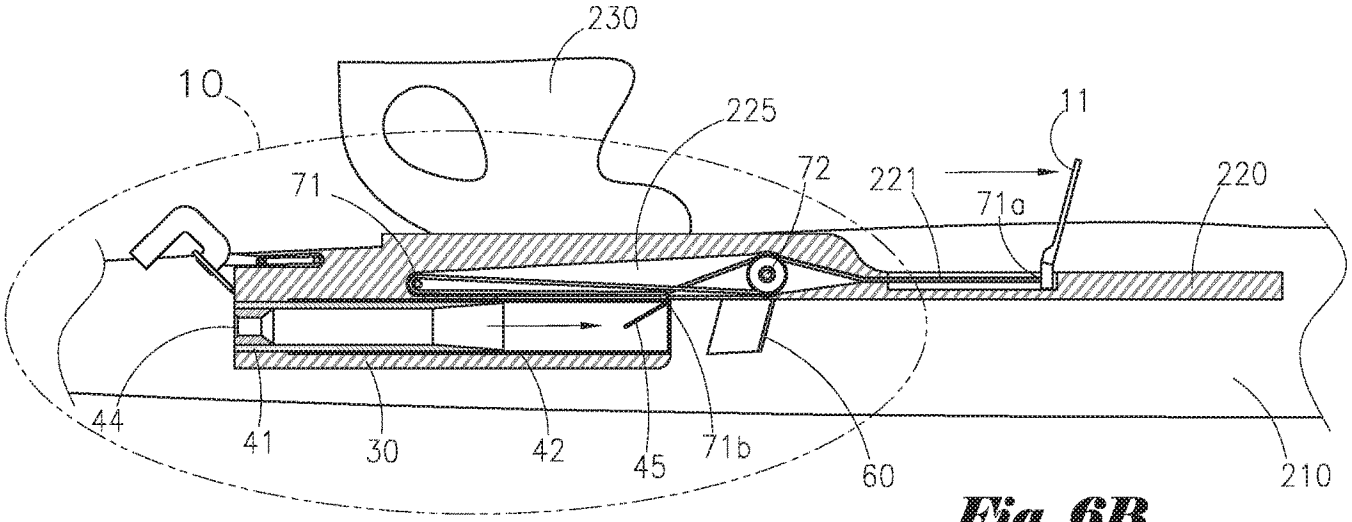
FIG. 6B depicts a side sectional view of the propulsion assembly of the present invention along line 6-6 of FIG. 3 in a second position.

FIG. 6A depicts a side sectional view of propulsion assembly of the present invention along line 6-6 of FIG. 3 in a first position, while FIG. 6B depicts a side sectional view of said propulsion assembly along line 6-6 of FIG. 3 in a second position. Catamaran watercraft 200 has hull 210 and deck 220. User seat 230 is disposed on the upper surface of deck 220 and generally faces forward (toward bow end 211 of hulls 210, depicted in FIG. 3). Elongated slot 221 extends through deck 220 in substantially parallel orientation to the longitudinal axis of hull 210. Pedal 11 is slidably disposed within elongated slot 221; said pedal 11 can move linearly within said elongated slot 221. Pedal 11 (and slot 221) are positioned so that pedal 11 can be conveniently and comfortably contacted by a left foot of a person positioned within seat 230, while also permitting space or clearance for said person to bend, flex and/or extend his/her legs while remaining in said seat 230.

Propulsion assembly 100 of the present invention further comprises at least one fluid propulsion chamber 40 operationally attached or mounted to said vessel 200. Propulsion chamber 40 is mounted within housing 30 disposed on the lower surface of deck 220. Hinged door 45 of fluid propulsion chamber is depicted in the closed position in FIG. 6A, while said hinged door 45 is depicted in the open position in FIG. 6B. Fluid diverter panel 60 is disposed on the underside or lower surface of deck 220 of vessel 200, and is generally aligned with the intake or inlet of said fluid propulsion chamber 200.

A linkage assembly operationally connects pedal 11 to fluid propulsion chamber 40 (and, more specifically, outer sleeve 42 of said fluid propulsion chamber 40). Force imparted on said pedal 11 (such as by the legs/feet of a user) is transferred to said fluid propulsion chamber 40 (and, more specifically, outer sleeve 42 of said fluid propulsion chamber 40) by said linkage assembly. In a preferred embodiment, said linkage assembly comprises cable 71 having first end 71*a* and second end 71*b*; first end 71*a* is operationally attached to pedal 11, while second end 71*b* is attached to outer sleeve 42 of fluid propulsion chamber 40.

As depicted in FIGS. 6A and 6B, cable 71 extends around pulleys 72 and 73 disposed in a chamber or space 225 formed within deck member 221 of watercraft 200. However, it is to be observed that other known linkage means can be employed without departing from the scope of the present invention. In the first position depicted in FIG. 6A, pedal 11 is positioned at or near the end of elongated slot 221 nearest to seat 230. In the second position depicted in FIG. 6B, pedal 11 is positioned at or near the opposite end of elongated slot 221, farthest away from seat 230.

Figure 7A:
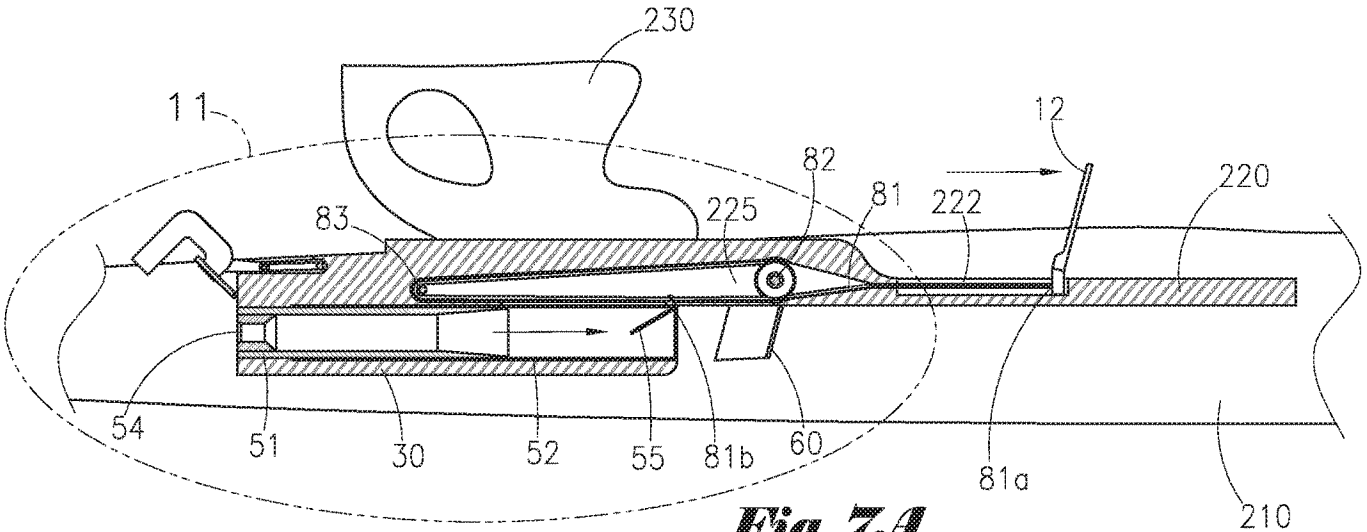
FIG. 7A depicts a side sectional view of the propulsion assembly of the present invention along line 7-7 of FIG. 3 in a first position.
Figure 7B:
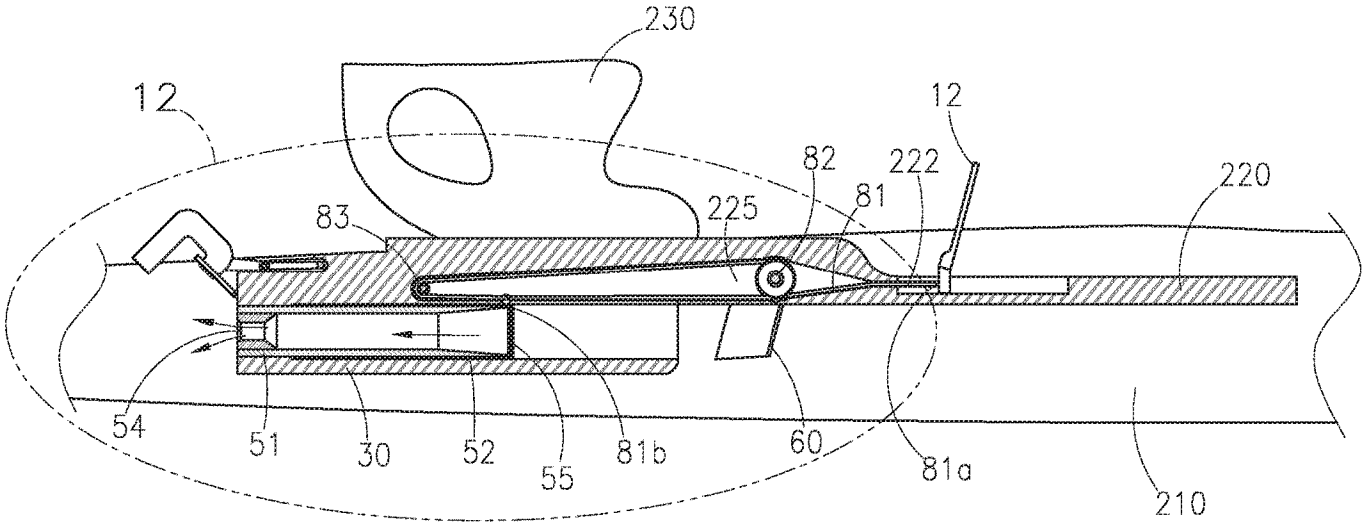
FIG. 7B depicts a side sectional view of the propulsion assembly of the present invention along line 7-7 of FIG. 3 in a second position.

FIG. 7A depicts a side sectional view of the propulsion assembly of the present invention along line 7-7 of FIG. 3 in a first position, while FIG. 7B depicts a side sectional view of said propulsion assembly along line 7-7 of FIG. 3 in a second position. As in FIGS. 6A and 6B, catamaran watercraft 200 has hull 210 and deck 220. User seat 230 is disposed on the upper surface of deck 220 and generally faces forward (toward bow end 211 of hulls 210, depicted in FIG. 3).

Elongated slot 222 extends through deck 220 in substantially parallel orientation to hull 210. Pedal 12 is slidably disposed within elongated slot 222; said pedal 12 can move within said elongated slot 222 along the longitudinal axis of said slot 222. Pedal 12 (and slot 222) are positioned so that pedal 12 can be conveniently and comfortably contacted by a foot of a person seated within seat 230, while also permitting space or clearance for said person to bend, flex and/or extend his/her legs.

The propulsion assembly of the present invention comprises at least one fluid propulsion chamber operationally attached or mounted to a vessel. Propulsion chamber 50 is mounted within housing 30 disposed on the lower surface of deck 220. Hinged door 55 of fluid propulsion chamber 50 is depicted in the open position in FIG. 7A, and the closed position in FIG. 7B. Fluid diverter panel 60 is disposed on the below lower surface of deck 220 of vessel 200, and is generally aligned with fluid propulsion chamber 50.

A linkage assembly operationally connects pedal 12 to fluid propulsion chamber 50 (and, more specifically, outer sleeve 52 thereof). Force imparted on said pedal 12 (such as by the legs/feet of a user) is transferred to said outer sleeve 53 of fluid propulsion chamber 50 by said linkage assembly. In a preferred embodiment, said linkage assembly comprises cable 81 having first end 81*a* and second end 81*b*; first end 81*a* is operationally attached to pedal 12, while second end 81*b* is attached to outer sleeve 52 of fluid propulsion chamber 50.

As depicted in FIGS. 7A and 7B, cable 81 extends around pulleys 82 and 83 disposed in an internal chamber or space 225 formed within deck member 221 of watercraft 200. However, it is to be observed that other known linkage means can be employed without departing from the scope of the present invention. In the first position depicted in FIG. 7A, pedal 12 is positioned at or near the end of elongated slot 222 nearest to seat 230. In the second position depicted in FIG. 7B, pedal 12 is positioned at or near the opposite end of elongated slot 222; that is, farthest away from seat 230.

Figure 8A:
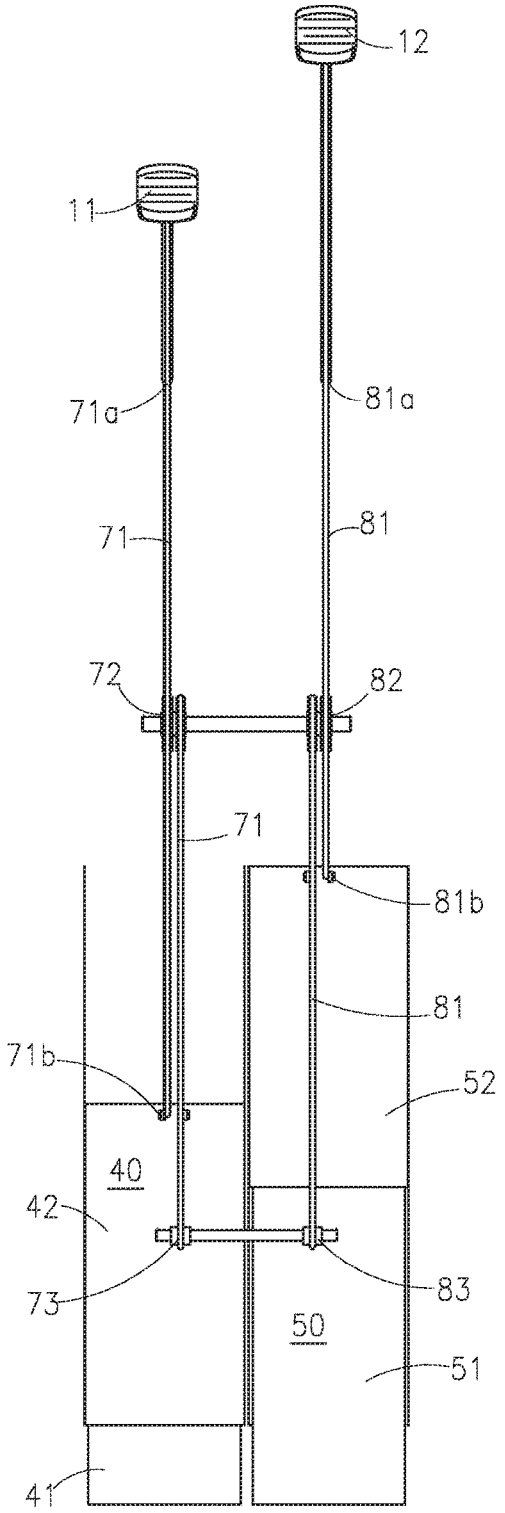
FIG. 8A depicts an overhead view of the drive assembly of the propulsion assembly of the present invention in a first position.
Figure 8B:
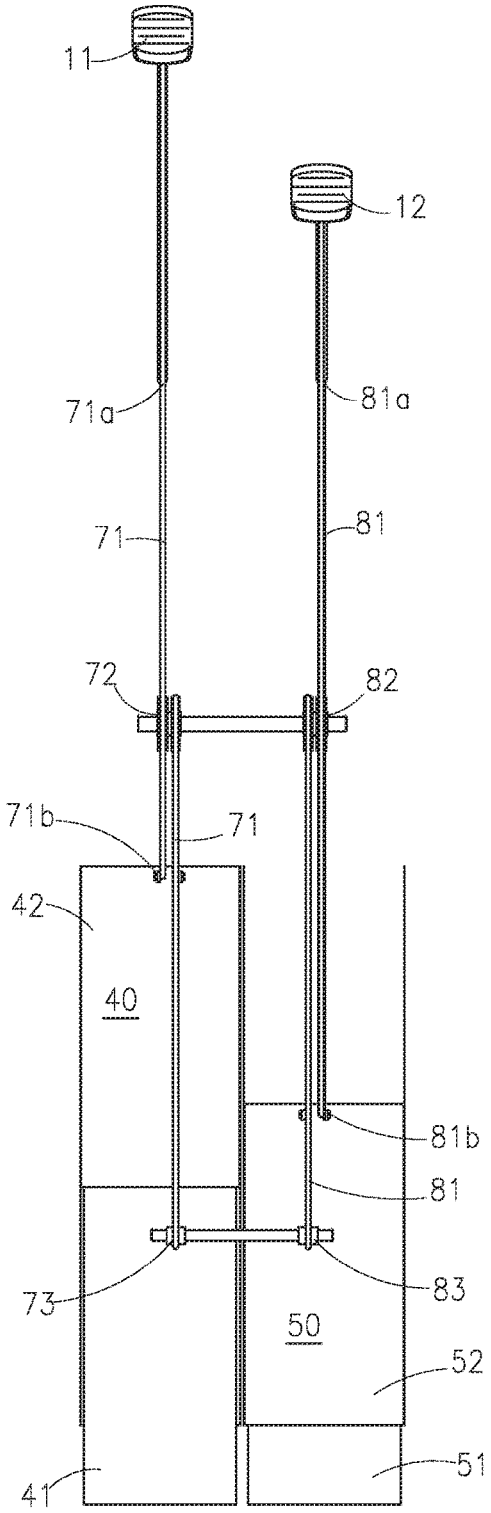
FIG. 8B depicts an overhead view of the drive assembly of the propulsion assembly of the present invention in a second position.

FIG. 8A depicts an overhead view of the drive assembly of the propulsion assembly of the present invention in a first position—that is, the same position depicted in FIGS. 6A and 7A. FIG. 8B depicts an overhead view of the drive assembly of the propulsion assembly of the present invention in a second position—that is, the same position depicted in FIGS. 6B and 7B. Cables 71 and 81, and associated pulleys, provide the direction of the motion; for example, pushing of a (right) pedal 12 causes retraction or collapsing of a left fluid propulsion chamber 40, while pushing of a (left) pedal 11 causes retraction or collapsing of a right fluid propulsion chamber 50. In a preferred embodiment, said pedals 11 and 12 each have a pedal stroke ranging from six to fourteen inches depending on the operator; however, said pedal strokes can be adjusted depending on user preferences.

As noted above, a linkage assembly operationally connects pedal 11 to fluid propulsion chamber 40. Force imparted on said pedal 11 (such as pushing by the legs/feet of a user) is transferred to said fluid propulsion chamber 40 by said linkage assembly. In a preferred embodiment, said linkage assembly comprises cable 71 having first end 71*a* and second end 71*b*; first end 71*a* is operationally attached to pedal 11, while second end 71*b* is attached to fluid propulsion chamber 40.

Similarly, said linkage assembly operationally connects pedal 12 to fluid propulsion chamber 50. Force imparted on said pedal 12 (such as pushing by the legs/feet of a user) is transferred to said fluid propulsion chamber 50 by said linkage assembly. In a preferred embodiment, said linkage assembly comprises cable 81 having first end 81*a* and second end 81*b*; first end 81*a* is operationally attached to pedal 12, while second end 81*b* is attached to fluid propulsion chamber 50.

Figure 9:
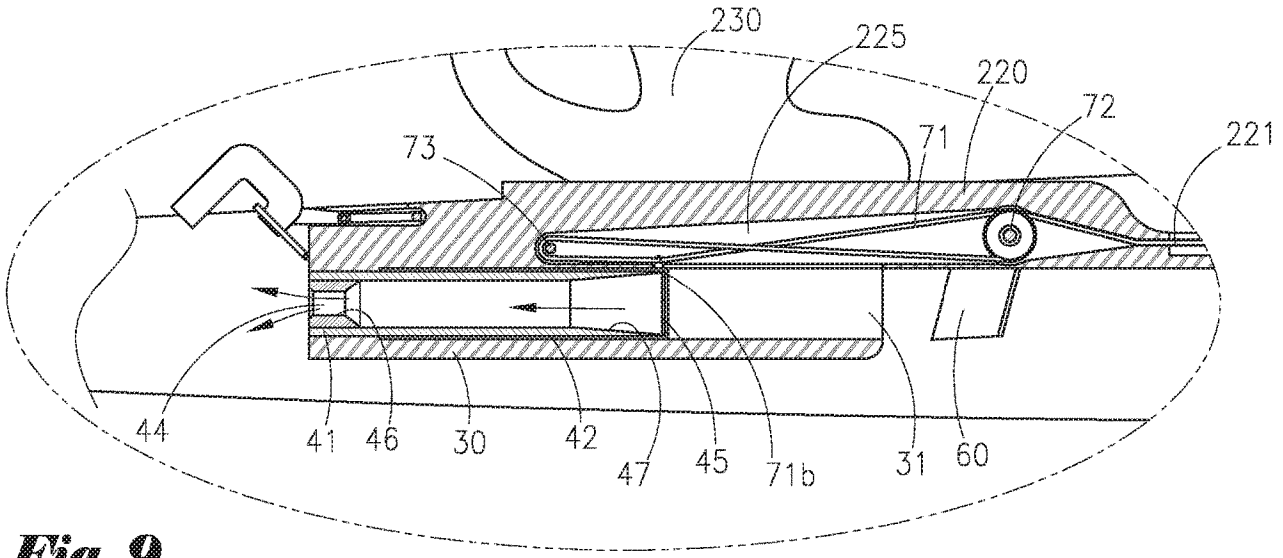
FIG. 9 depicts a detailed view of the highlighted area depicted in FIG. 6A.
Figure 10:
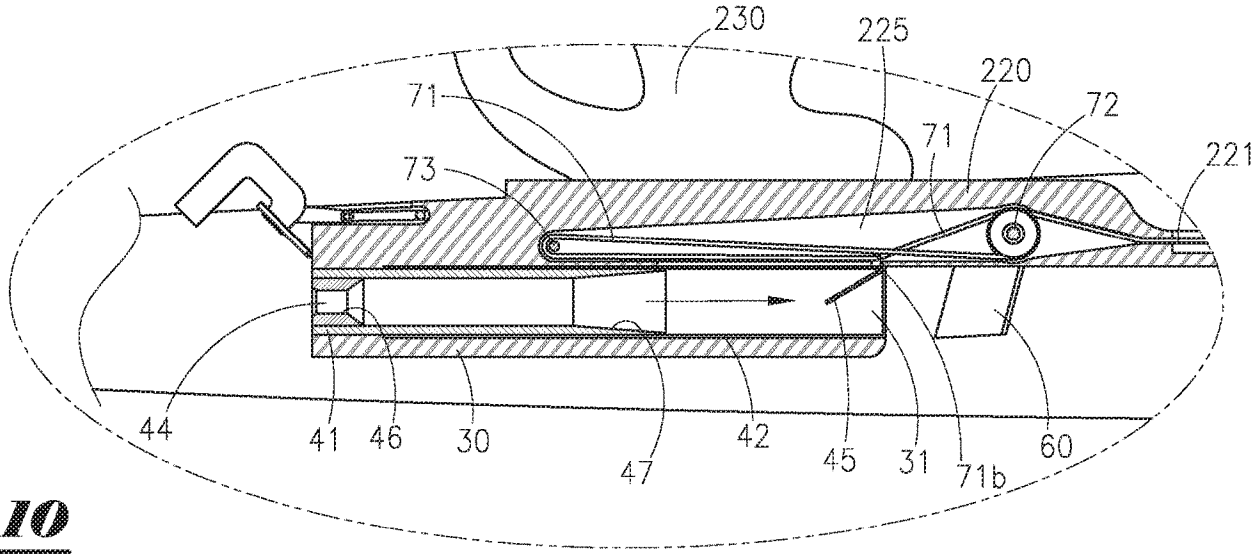
FIG. 10 depicts a detailed view of the highlighted area depicted in FIG. 6B.

FIG. 9 depicts a detailed view of the highlighted area depicted in FIG. 6A, while FIG. 10 depicts a detailed view of the highlighted area depicted in FIG. 6B. Cable 71 extends around pulleys 72 and 73 disposed in a chamber or space 225 formed within deck member 221 of watercraft 200. In the first position depicted in FIG. 9, it is to be understood that pedal 11 (not visible in FIG. 9) is positioned at or near the end of elongated slot 221 nearest to seat 230. In the second position depicted in FIG. 10, it is to be understood that said pedal 11 (not visible in FIG. 10) is positioned at or near the opposite end of elongated slot 221, farthest away from seat 230.

Figure 11:
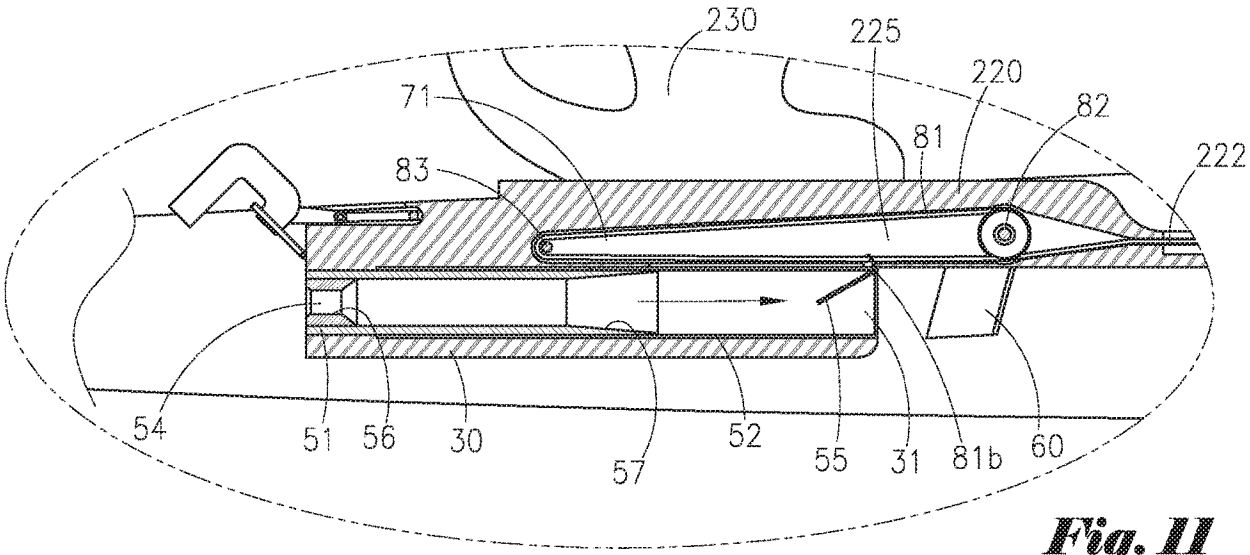
FIG. 11 depicts a detailed view of the highlighted area depicted in FIG. 7A.
Figure 12:
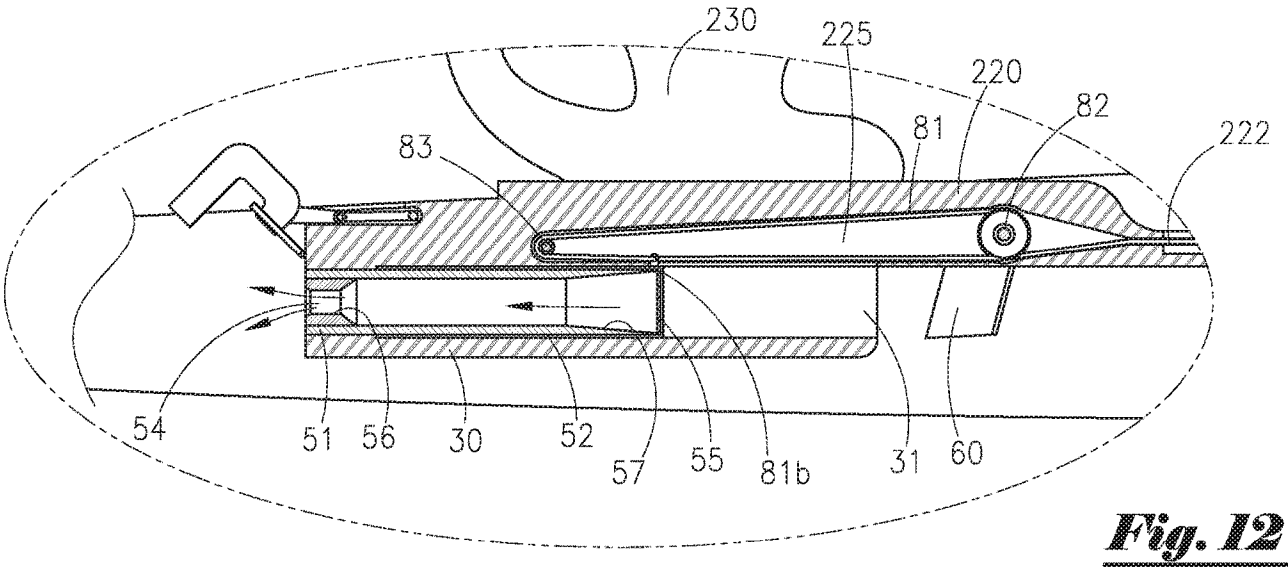
FIG. 12 depicts a detailed view of the highlighted area depicted in FIG. 7B.

FIG. 11 depicts a detailed view of the highlighted area depicted in FIG. 7A, while FIG. 12 depicts a detailed view of the highlighted area depicted in FIG. 7B. Cable 81 extends around pulleys 82 and 83 disposed in an internal chamber or space 225 formed within deck member 221 of watercraft 200. In the first position depicted in FIG. 11, it is to be understood that pedal 12 (not visible in FIG. 11) is positioned at or near the end of elongated slot 222 nearest to seat 230. In the second position depicted in FIG. 12, it is to be understood that pedal 12 (not visible in FIG. 12) is positioned at or near the opposite end of elongated slot 222; that is, farthest away from seat 230.

The forward or stern end of outer sleeve 42 has a hinged door or flap 45 to allow for water intake on a forward stroke; said flapper door 45 is hinged at the top and can swing inwardly as fluid enters said outer sleeve 42. Similarly, the forward or stern end of outer sleeve 52 also has a hinged door or flap 55 to allow for water intake on a forward stroke; said flapper door 55 is hinged at the top and can swing inwardly as fluid enters said outer sleeve 52. Each flapper door 45 and 55 opens on a forward stroke to allow the respective propulsion assembly to fill with water.

However, on a backstroke, said flapper door 45 drops down and closes to form a fluid pressure seal against outer sleeve 42 within fluid propulsion chamber 40. Similarly, on a backstroke, flapper door 55 drops down and closes to form a fluid pressure seal against outer sleeve 52 within fluid propulsion chamber 50. In a preferred embodiment, each of said outer sleeves 42 and 52 further comprises a lip to engage against and prevent said hinged door flaps 45 and 55, respectively, from over-swinging and extending outside of the respective outer sleeves when in the closed (lowered) position. Further, in a preferred embodiment, flapper door 45 is open when flapper door 55 is closed; conversely, flapper door 55 is open when flapper door 45 is closed. Put another way, said flapper doors 45 and 55 beneficially alternate between open (upper) and closed (lower) positions relative to each other.

Referring to FIG. 10, as fluid propulsion chamber 40 extends (that is, as outer sleeve 42 moves axially forward relative to substantially stationary inner sleeve 41), the inner volumetric capacity of said fluid propulsion chamber 40 (that is, the combined inner volumes of cooperating outer sleeve 42 and inner sleeve 41) increases, and water is drawn into said fluid propulsion chamber 40 through aperture 31 of housing 30 and open flap 45. Similarly, referring to FIG. 11, as fluid propulsion chamber 50 extends (that is, as outer sleeve 52 moves axially forward relative to substantially stationary inner sleeve 51), the inner volumetric capacity of said fluid propulsion chamber 50 (that is, the combined inner volumes of cooperating outer sleeve 52 and inner sleeve 51) increases, and water is drawn into said fluid propulsion chamber 50 through aperture 31 of housing 30 and open flap 55.

Referring to FIG. 9, as fluid propulsion chamber 40 retracts (that is, as outer sleeve 42 moves axially inward relative to substantially stationary inner sleeve 41), the inner volumetric capacity of said fluid propulsion chamber 40 (that is, the combined inner volumes of cooperating outer sleeve 42 and inner sleeve 41) decreases; with flap 45 closed, incompressible liquid is forced or expelled out jet nozzle 44. Similarly, referring to FIG. 12, as fluid propulsion chamber 50 retracts (that is, as outer sleeve 52 moves axially inward relative to substantially stationary inner sleeve 51), the inner volumetric capacity of said fluid propulsion chamber 50 (that is, the combined inner volumes of cooperating outer sleeve 52 and inner sleeve 51) decreases; with flap 55 closed, incompressible liquid is forced or expelled out jet nozzle 54. Water expelled from outlet nozzles 44 and 54 creates positive thrust which is used to propel vessel 200; because said outlet nozzles 44 and 54 are oriented toward the stern of vessel 200, said thrust propels vessel 200 in a substantially forward direction.

In operation, a user positioned within seat 230 can selectively impart force on said moveable pedals 11 and 12, typically in an alternating manner, using force generated by said user's legs. Said force is transferred from said pedals 11 and 12 to said fluid propulsion chambers 40 and 50. More specifically, force acting on said pedals 11 and 12 is conveyed via linkage assemblies and transferred to outer housings 42 and 52, thereby causing said outer housings 42 and 52 to move relative to substantially stationary inner sleeves 41 and 51, respectively, to slidably move and interact relative to one another. In a preferred embodiment, inner bores of inner sleeves 41 and 51 can each have a tapered profile, wherein each of said inner bores is wider at one longitudinal end that at an opposite longitudinal end.

The bow (intake) ends of said fluid propulsion chambers 40 and 50 beneficially have debris filters/deflectors 60 separated by several inches or more and angled downward to prevent debris from building up on said deflectors. In a preferred embodiment, a first debris deflector 60 can be larger and is positioned to block or obstruct the bow end of said fluid propulsion chambers 40 and 50 and prevent solids from entering the intake openings thereof (via opening 31). At least one deflector 60 can be curved to encompass the sides of a secondary line of deflectors 60; said second line of filters can be smaller and is designed to function with respect to each fluid propulsion chamber 40 and 50.

In a preferred embodiment, said fluid propulsion chambers 40 and 50 operate in alternating forward (intake) and backward (compression) strokes. Typically, said fluid propulsion chambers are mounted or oriented so that each outlet nozzle or jet faces the rear or stern of vessel 200. As a result, positive thrust created by liquid expelled from said fluid propulsion chambers has the effect of propelling a vessel 200 forward (that is, the opposite direction that the outlet nozzle (s) face).

Figure 13:
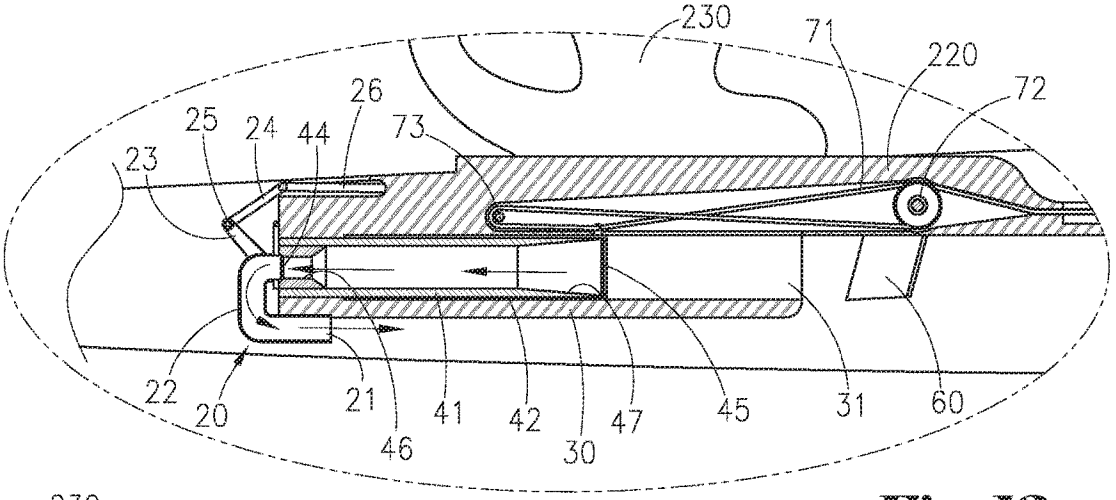
FIG. 13 depicts the view depicted in FIG. 9, with a fluid flow diverter engaged.
Figure 14:
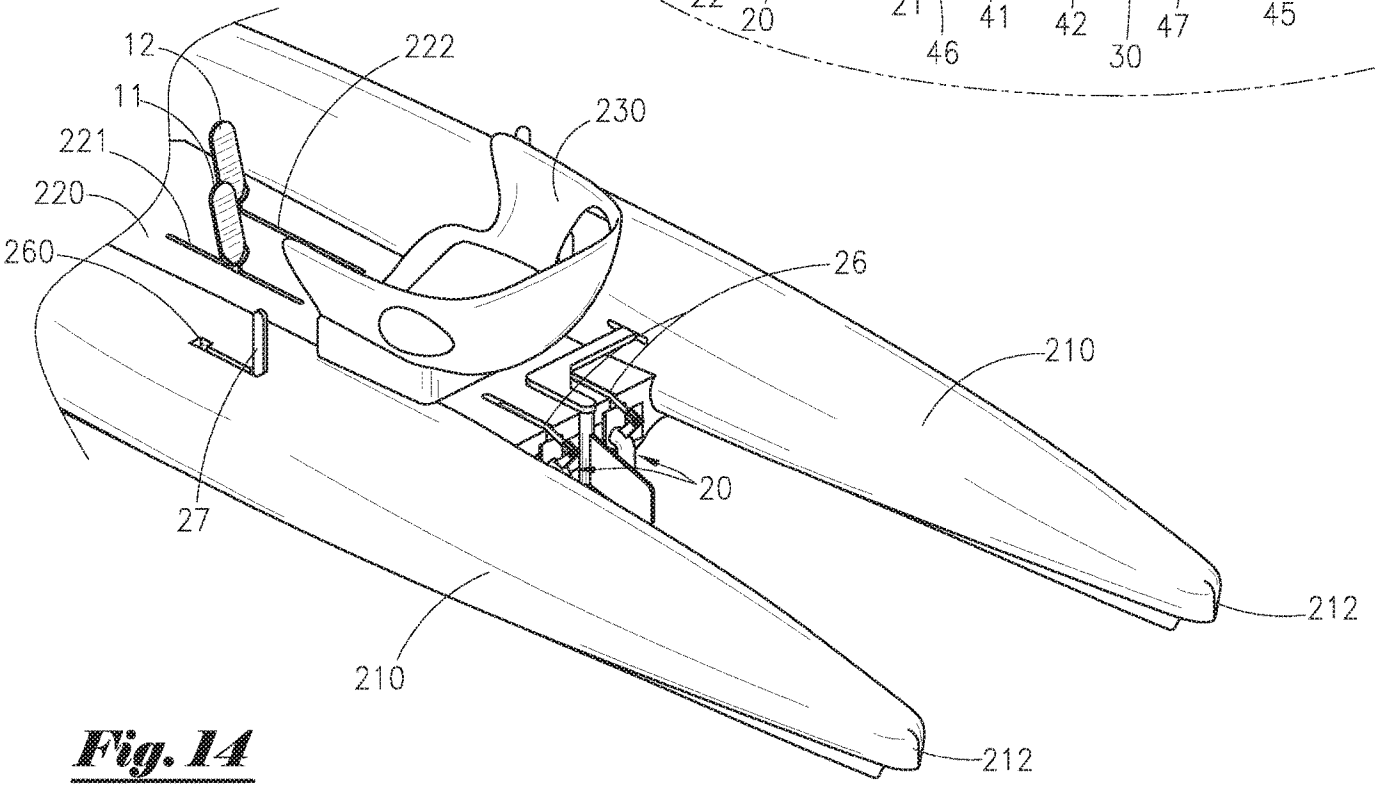
FIG. 14 depicts a rear perspective view of the propulsion assembly of the present invention installed on a conventional watercraft, with fluid flow diverters engaged.

FIG. 13 depicts the view depicted in FIG. 9; a fluid flow diverter 20 is engaged against an outlet nozzle of a fluid propulsion chamber. FIG. 14 depicts a rear perspective view of the propulsion assembly of the present invention installed on a conventional watercraft, with fluid flow diverters 20 engaged. In a preferred embodiment, said fluid flow diverters 20 are pivotally attached to vessel 200, and can be selectively engaged using a linkage system controlled by a user in seat 230 to redirect fluid flow from said outlet nozzle or jet in a different direction. In the embodiments depicted in FIG. 13 and FIG. 14, fluid flow that is normally directed toward the stern of vessel 200 is redirected toward the bow of said vessel 200, thereby allowing positive thrust to move said vessel 200 in a backward or "reverse" direction.

The present invention comprises a propulsion system for virtually any type of non-motorized personal watercraft including, without limitation, kayaks and/or catamarans. Said propulsion system uses water pressure that is generated by fluid propulsion chambers positioned under the vessel and powered by the legs/feet of an operator. However, because said fluid propulsion chambers do not extend below or beyond the hull(s) of a vessel or watercraft, the present invention can be used in relatively shallow water depths without said propulsion assembly inadvertently contacting a water bottom or underwater obstruction (like conventional flaps or flippers).

The watercraft propulsion assembly of the present assembly can be mounted on and used in connection with "home-made" or kit-constructed kayaks that are commonly made from foam board or the like. Further, the watercraft propulsion assembly of the present invention can be incorporated into a new vessel as part of the manufacturing process, or can be installed or "retrofit" to an existing vessel as an added or aftermarket component.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A watercraft propulsion apparatus for propelling a non-motorized vessel through water comprising:

a) at least one fluid propulsion assembly operationally attached to said watercraft, wherein said at least one fluid propulsion assembly is configured to selectively expel water in a predetermined direction to create thrust, and wherein said at least one fluid propulsion assembly further comprises:
   i) an inner sleeve having a first end and a second end;
   ii) a fluid jet nozzle disposed through said first end of said inner sleeve; and
   iii) an outer sleeve having a first end, a second end and a flapper door hingedly attached to said second end, wherein said outer sleeve is slidably disposed over at least a portion of said inner sleeve;

b) at least one pedal movably disposed on said watercraft; and c) a linkage assembly connecting said at least one pedal to said at least one fluid propulsion assembly.

2. The watercraft propulsion apparatus of claim 1, wherein said linkage assembly further comprises at least one cable and at least one pulley.

3. The watercraft propulsion apparatus of claim 1, wherein force applied to said at least one pedal is transferred to said outer sleeve of said at least one fluid propulsion assembly by said linkage assembly.

4. The watercraft propulsion apparatus of claim 3, wherein said inner sleeve and said outer sleeve of said at least one fluid propulsion apparatus are configured to selectively alternate between an extended position and a collapsed position.

5. The watercraft propulsion apparatus of claim 4, wherein said flapper door is closed when said inner sleeve and said outer sleeve alternate between said extended position and said collapsed position.

6. The watercraft propulsion apparatus of claim 4, wherein said flapper door is closed when said inner sleeve and said outer sleeve alternate between said collapsed position and said extended position.

7. A watercraft propulsion apparatus for propelling a vessel through water comprising:

a) a first fluid propulsion assembly operationally attached to said vessel, wherein said first fluid propulsion assembly further comprises:
   i) a first inner sleeve having a first end and a second end;
   ii) a first fluid jet nozzle disposed through said first end of said first inner sleeve; and
   iii) a first outer sleeve having a first end, a second end and a first flapper door hingedly attached to said second end of said first outer sleeve, wherein said first outer sleeve is slidably disposed over at least a portion of said first inner sleeve;

b) a second fluid propulsion assembly operationally attached to said vessel, wherein said first and second fluid propulsion assemblies are configured to selectively expel water in a predetermined direction to create thrust;

c) a first pedal movably disposed on said vessel;

d) a second pedal moveably disposed on said vessel;

e) a first linkage assembly connecting said first pedal to said first fluid propulsion assembly; and f) a second linkage assembly connecting said second pedal to said second fluid propulsion assembly.

8. The watercraft propulsion apparatus of claim 7, wherein said second fluid propulsion assembly further comprises:

a) a second inner sleeve having a first end and a second end;

b) a second fluid jet nozzle disposed through said first end of second said inner sleeve; and c) a second outer sleeve having a first end, a second end and a flapper door hingedly attached to said second end of said second outer sleeve, wherein said second outer sleeve is slidably disposed over at least a portion of said second inner sleeve.

9. The watercraft propulsion apparatus of claim 7, wherein said first linkage assembly further comprises at least one cable and at least one pulley.

10. The watercraft propulsion apparatus of claim 9, wherein said second linkage assembly further comprises at least one cable and at least one pulley.

11. The watercraft propulsion apparatus of claim 7, wherein said first inner sleeve and said first outer sleeve of said first fluid propulsion apparatus are configured to selectively alternate between an extended position and a collapsed position.

12. The watercraft propulsion apparatus of claim 11, wherein said second inner sleeve and said second outer sleeve of said second fluid propulsion apparatus are configured to selectively alternate between an extended position and a collapsed position.

13. The watercraft propulsion apparatus of claim 12, wherein said first fluid propulsion apparatus is in a collapsed position when said second propulsion assembly is in an extended position.

14. A method for propelling a vessel through water comprising:

a) providing a water craft propulsion apparatus, comprising:
   i) a first fluid propulsion assembly operationally attached to said vessel wherein said first fluid propulsion assembly is configured to selectively alternate between an extended position wherein water flows into said first fluid propulsion assembly, and a collapsed position wherein water is expelled from said first fluid propulsion assembly;

ii) a second fluid propulsion assembly operationally attached to said vessel, wherein said first and second fluid propulsion assemblies are configured to selectively expel water in a predetermined direction to create thrust;

iii) a first pedal movably disposed on said vessel;

iv) a second pedal moveably disposed on said vessel;

v) a first linkage assembly connecting said first pedal to said first fluid propulsion assembly;

v) a second linkage assembly connecting said second pedal to said second fluid propulsion assembly;

b) applying force to said first pedal;

c) expelling water from said first fluid propulsion assembly;

d) applying force to said second pedal; and e) expelling water from said second fluid propulsion assembly.

15. The method of claim 14, wherein said second fluid propulsion assembly is configured to selectively alternate between an extended position wherein water flows into said second fluid propulsion assembly, and a collapsed position wherein water is expelled from said second fluid propulsion assembly.

16. The method of claim 15, wherein said first fluid propulsion apparatus is in said collapsed position when said second propulsion assembly is in said extended position, and said first fluid propulsion apparatus is in said extended position when said second propulsion assembly is in said collapsed position.

* * * * *